US006235980B1

(12) United States Patent
Sato

(10) Patent No.: US 6,235,980 B1
(45) Date of Patent: May 22, 2001

(54) APPARATUS AND METHOD FOR GENERATING WAVEFORM DATA FOR MUSICAL TONE SIGNAL GENERATING APPARATUS

(75) Inventor: Hiroshi Sato, Hamamatsu (JP)

(73) Assignee: Kabushiki Kaisha Kawai Gakki Seisakusho, Hamamatsu (JP)

( * ) Notice: Subject to any disclaimer, the term of this patent is extended or adjusted under 35 U.S.C. 154(b) by 0 days.

(21) Appl. No.: 09/543,554

(22) Filed: Apr. 5, 2000

(30) Foreign Application Priority Data

Apr. 6, 1999 (JP) ..... 11-099454
Mar. 28, 2000 (JP) ..... 12-088811

(51) Int. Cl.[7] ..... G10H 1/06; G10H 7/00
(52) U.S. Cl. ..... 84/623; 84/622; 84/624; 84/659
(58) Field of Search ..... 84/600–608, 615–618, 84/622–627, 653–656, 659–661, 662–663

(56) References Cited

U.S. PATENT DOCUMENTS 4,779,505 10/1988 Suzuki ..... 84/1.22

FOREIGN PATENT DOCUMENTS 5-1480 3/1985 (JP) .

*Primary Examiner*—Robert E. Nappi
*Assistant Examiner*—Marlon T. Fletcher
(74) *Attorney, Agent, or Firm*—Christie, Parker & Hale, LLP

(57) ABSTRACT

A synthesized strong hit waveform data is generated by synthesizing a strong hit amplitude component separated from a strong hit waveform data generated based on tone of a strong play and a weak hit phase component separated from a weak hit waveform data generated based on tone of a weak play. This synthesized strong hit waveform data is stored in a memory together with a weak hit waveform data. A musical tone signal is generated by interpolating the weak hit waveform data and the synthesized strong hit waveform data read out from the memory, in response to a signal supplied from external portion.

18 Claims, 7 Drawing Sheets

Fig. 2A

STRONG HIT WAVEFORM DATA($Aa_i$, $Pa_i$)

TIME

| DEGREE OF HARMONIC | AMPLITUDE | PHASE |
|---|---|---|
| 1 | $Aa_1$ | $Pa_1$ |
| 2 | $Aa_2$ | $Pa_2$ |
| 3 | $Aa_3$ | $Pa_3$ |
| | | |

Fig. 2B

WEAK HIT WAVEFORM DATA($Ac_i$, $Pc_i$)

TIME

| DEGREE OF HARMONIC | AMPLITUDE | PHASE |
|---|---|---|
| 1 | $Ac_1$ | $Pc_1$ |
| 2 | $Ac_2$ | $Pc_2$ |
| 3 | $Ac_3$ | $Pc_3$ |
| | | |

$Aa_i$ $Pc_i$

Fig. 2C

SYNTHESIZED WAVEFORM DATA($Aa_i$, $Pc_i$)

TIME

| DEGREE OF HARMONIC | AMPLITUDE | PHASE |
|---|---|---|
| 1 | $Aa_1$ | $Pc_1$ |
| 2 | $Aa_2$ | $Pc_2$ |
| 3 | $Aa_3$ | $Pc_3$ |
| | | |

APPARATUS AND METHOD FOR GENERATING WAVEFORM DATA FOR MUSICAL TONE SIGNAL GENERATING APPARATUS

BACKGROUND OF THE INVENTION

1. Field of the Invention

The present invention relates to a waveform data generating apparatus and a waveform data generating method which generate a waveform data applied to, for example, an electronic musical instrument, and relates to a musical tone signal generating apparatus for generating a musical tone signal in accordance with the waveform data generated by the waveform data generating apparatus or the waveform data generating method.

2. Description of the Related Art

It is generally known that in a tone generated by an acoustic musical instrument, play strength causes a tone volume to be changed, and also causes a tone color to be changed. In this specification, the play strength implies the strength of a touch in a case of a keyboard instrument such as a piano and a cembalo, the strength of a rub in a case of a rubbed string instrument such as a violin and a cello, and the strength of a sucked breath in a case of a wind instrument such as a trumpet and a clarinet.

The change of the tone color in accordance with this play strength is mainly caused by levels of respective harmonics (frequency characteristic) constituting the musical tone and envelopes of the respective harmonics, namely, the temporal change of the level of the respective harmonics. For example, as the play strength becomes stronger, levels of high harmonics become higher to accordingly generate brighter tone. Also, as the play strength becomes stronger, a leading edge of the envelope becomes sharper to accordingly generate tone having sharper attack. Moreover, the changing situations of the respective harmonics are different from each other to accordingly generate a complexly changed abundant tone color.

A conventional electronic instrument employs the following techniques in order to simulate the change of the tone color in the above-mentioned acoustic instrument.

In a first technique, n (n is a positive integer) kinds of waveform data generated on the basis of tone generated in accordance with n kinds of different play strengths are stored in a waveform memory. Then, when a key is hit, a waveform data corresponding to the play strength is read out from the waveform memory to generate the tone. However, in this first technique, if the n is small, the tone color is sharply changed in accordance with the play strength. Thus, the change of the tone color becomes unnatural. To smoothly switch the tone color in accordance with the play strength, it is necessary that the n is a very large value. As a result, a large capacity of a waveform memory is required to thereby make the electronic instrument expensive.

In a second technique, m (m is a positive integer and m<n) kinds of waveform data generated on the basis of tone generated in accordance with m different play strengths are stored in the waveform memory. Then, when the key is hit, two kinds of waveform data are selected from the m kinds of waveform data in accordance with the play strength. Then, the selected two kinds of waveform data are interpolated in accordance with the play strength to generate the tone. According to this second technique, an amount of waveform data to be stored in the waveform memory may be smaller than that of the first technique. However, respective phases of the two kinds of waveform data are different from each other. Thus, when the interpolation is done, phase interference is induced to thereby cause the tone color to be damaged.

In a third technique, only one waveform data generated on the basis of tone generated in accordance with strong play strength is stored in the waveform memory. Then, a signal generated in accordance with this waveform data is filtered by such a filter that a characteristic is changed in accordance with the play strength. However, if the play strength is weak the tone color is unnatural in this third technique.

In order to solve the problem of the phase interference in the second technique, Japanese Laid Open Patent Application (JP-A-Showa 60-55398) corresponding to Japanese Examined Patent Application (JP-B-Heisei 5-1480) discloses a waveform generating method in an electronic instrument. However, this waveform generating method only matches phases as an entire waveform. Thus, the phase interference is induced in an individual harmonic, which results in a problem that the tone color is damaged.

Also, the Japanese Laid Open Patent Application (JP-A-Showa 60-55398) corresponding to Japanese Examined Patent Application (JP-B-Heisei 5-1480) discloses a technique of performing a phase matching operation on a first waveform by using a filter, and then generating a second waveform. According to this technique, since the second waveform is generated in accordance with the first waveform, a phase deviation does not occur between both the first waveform and the second waveform. However, the phase matching operation is performed on the first waveform by using the filter. Thus, the envelopes of the respective harmonics included in the second waveform become all equal. Hence, the complex change of the tone color in accordance with the play strength can not be obtained.

Moreover, a method is well known for simulating the change of the tone color by combining the first and third techniques. In this method the waveform data obtained in accordance with the strong play strength and the waveform data obtained in accordance with the weak play strength is actually prepared. Then, any of both the waveform data is selected with certain touch strength as a boundary. However, this method can not obtain the smooth change of the tone color since the respective harmonics are sharply changed.

SUMMARY OF THE INVENTION

Therefore, a first object of the present invention is to provide a waveform data generating apparatus and a waveform data generating method that generate a waveform data in which a smooth change of a tone color is obtained in accordance with a play strength, similarly to a natural instrument.

A second object of the present invention is to provide a musical tone signal generating apparatus for generating a musical tone signal in which a smooth change of a tone color is obtained in accordance with a play strength, similarly to a natural instrument, irrespectively of a small scale and a low cost.

In order to accomplish the first object, a waveform data generating apparatus according to a first aspect of the present invention includes a separator and a synthesizer. The separator separates n kinds of amplitude components and n kinds of phase components from n kinds of waveform data, where n is an integer equal to or greater than 2. The synthesizer synthesizes each of m kinds of amplitude components selected from the n kinds of amplitude components separated by the separator and one of the n kinds of phase components to generate m kinds of synthesized waveform data, where m is an integer equal to or greater than 1, and $m \leqq n$.

In order to accomplish the first object, a waveform data generating method according to a second aspect of the present invention includes a separating step and a synthesizing step. In the separating, n kinds of amplitude components and n kinds of phase components from n kinds of waveform data are separated from n kinds of waveform data, where n is an integer equal to or greater than 2. In the synthesizing, each of m kinds of amplitude components selected from the n kinds of amplitude components and one of the n kinds of phase components are synthesized to generate m kinds of synthesized waveform data, where m is an integer equal to or greater than 1, and $m \leqq n$.

In order to attain the second object, a musical tone signal generating apparatus according to a third aspect of the present invention includes a memory, an interpolation circuit and a musical tone signal generator. The memory stores a weak hit waveform data generated based on a tone of a weak play strength and a synthesized strong hit waveform data generated by synthesizing a strong hit amplitude component separated from a strong hit waveform data generated based on a tone of a strong play strength and a weak hit phase component separated from the weak hit waveform data. The interpolation circuit interpolates the weak hit waveform data and the synthesized strong hit waveform data read out from the memory, in response to a externally supplied signal indicative of a play strength. The musical tone signal generator generates a musical tone signal based on a waveform data interpolated by the interpolation circuit.

BRIEF DESCRIPTION OF THE DRAWINGS

For a better understanding of the present invention, reference is made of a detailed description, to be read in conjunction with the accompanying drawings, in which:

FIGS. 2A to 2C are explanatory diagrams for explaining a waveform data and an operation for synthesizing a waveform used in the first embodiment of the present invention;

DETAILED DESCRIPTION

Referring now to drawings, embodiments of the present invention will be described below. A case of generating a waveform data to generate piano tone will be described below. However, the present invention is not limited to the piano tone. Thus, the present invention can be applied to such a case that waveform data of all tones in all instruments are generated.

First Embodiment

Figure 1:
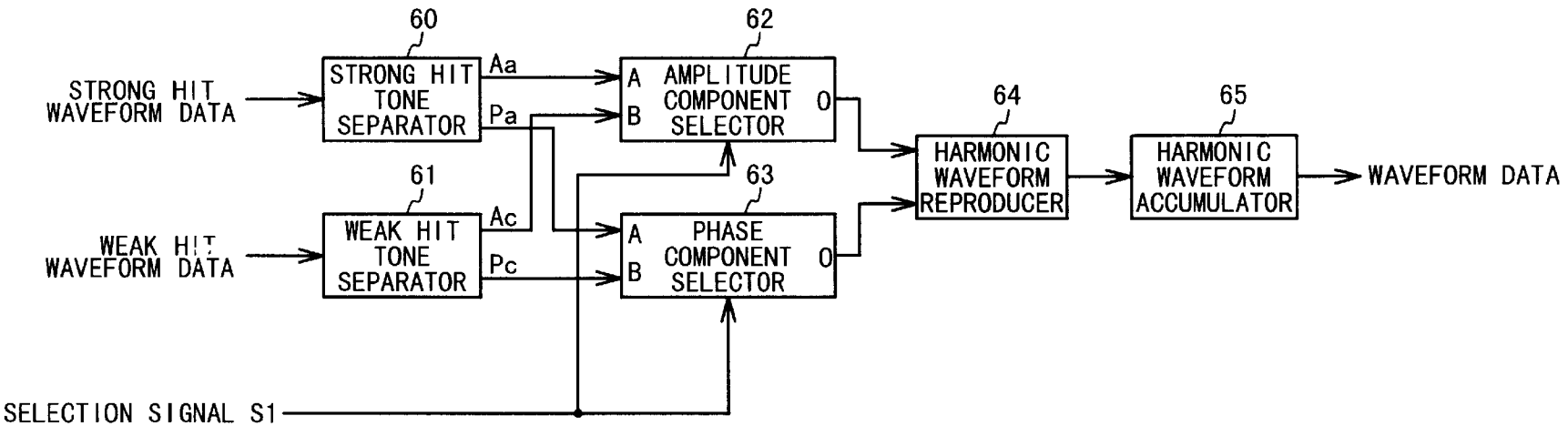
FIG. 1 is a functional block diagram showing a functional configuration of a waveform data generating apparatus according to a first embodiment of the present invention.

FIG. 1 is a functional block diagram showing a functional configuration of a waveform data generating apparatus according to a first embodiment of the present invention. Respective blocks shown in FIG. 1 may be attained in software or hardware.

A strong hit waveform data used in this waveform data generating apparatus is generated by performing a pulse code modulation (PCM) on a signal according to a tone generated by hitting a keyboard of a piano strongly. A sound pressure level of the tone is larger than a predetermined level SL. Similarly, a weak hit waveform data is generated by performing the pulse code modulation on the signal according to a tone generated by hitting the keyboard of the piano weakly. A sound pressure level of the tone is smaller than the predetermined level SL.

Hereafter, the strong hit waveform data is represented by $W_t(Aa_i, Pa_i)$ and the weak hit waveform data is represented by $W_t(Ac_i, Pc_i)$. Here, the $Aa_i$ and the $Ac_i$ represent a strong hit amplitude component and a weak hit amplitude component, respectively. The $Pa_i$ and the $Pc_i$ represent a strong hit phase component and a weak hit phase component, respectively. Also, the suffix (i) represents a degree of a harmonic, and the suffix (t) represents a time. In this case, the $W_t(Aa_i, Pa_i)$ can be conceptually represented as shown in FIG. 2A. Similarly, the $W_t(Ac_i, Pc_i)$ can be represented as shown in FIG. 2B.

The waveform data generating apparatus is composed of a strong hit tone separator 60, a weak hit tone separator 61, an amplitude component selector 62, a phase component selector 63, a harmonic waveform reproducer 64 and a harmonic waveform accumulator 65.

The strong hit tone separator 60 separates the strong hit amplitude component $Aa_i$ and the strong hit phase component $Pa_i$ from the inputted strong hit waveform data $W_t(Aa_i, Pa_i)$ for each harmonic, and sequentially outputs them. The strong hit amplitude component $Aa_i$ separated by this strong hit tone separator 60 is sent to the amplitude component selector 62, and the strong hit phase component $Pa_i$ is sent to the phase component selector 63. The weak hit tone separator 61 separates the weak hit amplitude component $Ac_i$ and the weak hit phase component $Pc_i$ from the inputted weak hit waveform data for each harmonic, and sequentially outputs them. The weak hit amplitude component $Ac_i$ separated by this weak hit tone separator 61 is sent to the amplitude component selector 62, and the weak hit phase component $Pc_i$ is sent to the phase component selector 63.

Figure 3:
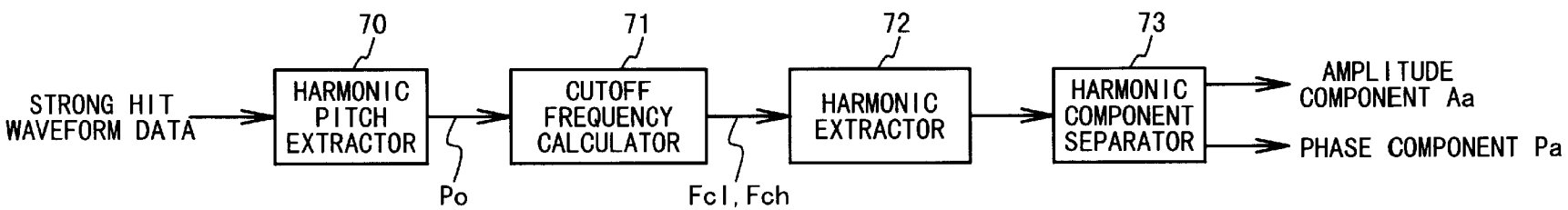
FIG. 3 is a functional block diagram showing a configuration of a weak hit tone separator and a strong hit tone separator in FIG. 1.

The configuration of the weak hit tone separator 61 is equal to that of the strong hit tone separator 60. Thus, only the strong hit tone separator 60 will be described below. FIG. 3 is a functional block diagram showing the functional configuration of the strong hit tone separator 60. Each block shown in FIG. 3 may be attained in software or hardware. This strong hit tone separator 60 is composed of a harmonic pitch extractor 70, a cutoff frequency calculator 71, a harmonic extractor 72 and a harmonic component separator 73.

The harmonic pitch extractor 70 extracts a pitch Po from the strong hit waveform data $W_t(Aa_i, Pa_i)$. This extracted pitch Po is sent to the cutoff frequency calculator 71. Here, a pitch of each harmonic can be extracted by searching a peak position on a frequency axis of a spectrum obtained by performing a Fast Fourier Transform (FFT) on the inputted strong hit waveform data $W_t(Aa_i, Pa_i)$ Also, the pitch of each harmonic may be designed such that the harmonic is picked up by applying a band pass filter in the vicinity of a position at which the harmonic may be located and then applying a method using an auto-correlation function or searching an interval between zero crossing points.

The cutoff frequency calculator 71 calculates a cutoff frequency Fc1 on a low band side and a cutoff frequency Fch on a high band side, in order to create a band pass filter having a band width Fb, with the extracted pitch Po of the harmonic as a center. The cutoff frequency Fc1 on the low band side is obtained by using an equation of, for example, Fc1=Po−Fb/2. Also, the cutoff frequency Fch on the high band side is obtained by using an equation of, for example, Fch=Po+Fb/2.

Those cutoff frequencies Fc1 and Fch are sent to the harmonic extractor 72. The harmonic extractor 72 filters the inputted strong hit waveform data $W_t$ ($Aa_i$, $Pa_i$) through the band pass filter having the cutoff frequencies Fc1, Fch and a sharp cutoff property. Accordingly, a waveform of each harmonic is extracted. The extracted waveform of each harmonic is sent to the harmonic component separator 73.

The harmonic component separator 73 separates the strong hit amplitude component $Aa_i$ and the strong hit phase component $Pa_i$ from the waveform of the harmonic sent from the harmonic extractor 72. In this case, a wavelength for each period can be used as the strong hit phase component $Pa_i$. Also, an element in which an amplitude value of the waveform of the harmonic is divided by an amplitude value of a sine wave having the same wavelength as the period for each period can be used as the strong hit amplitude component $Aa_i$. The strong hit tone separator 60 outputs the thus-separated strong hit amplitude component $Aa_i$ and strong hit phase component $Pa_i$ to external portion. It should be noted that the weak hit tone separator 61 separates the weak hit amplitude component $Ac_i$ and the weak hit phase component $Pc_i$ from the inputted weak hit waveform data $W_t$ ($Ac_i$, $Pc_i$) and outputs them to external portion by using the method similar to the above-mentioned method.

Referring to FIG. 1, the amplitude component selector 62, if a selection signal S1 of one bit sent from external portion is "0", selects the strong hit amplitude component $Aa_i$ from the strong hit tone separator 60, and if it is "1", selects the weak hit amplitude component $Ac_i$ from the weak hit tone separator 61, and then sends to the harmonic waveform reproducer 64. The phase component selector 63, if the selection signal S1 is "0", selects the weak hit phase component $Pc_i$ from the weak hit tone separator 61, and if it is "1", selects the strong hit phase component $Pa_i$ from the strong hit tone separator 60, and then sends to the harmonic waveform reproducer 64.

The harmonic waveform reproducer 64 reproduces the harmonic waveform based on the amplitude component from the amplitude component selector 62 and the phase component from the phase component selector 63. The technique is well known to generate the harmonic waveform (sine waveform) based on those values if the respective values of the amplitude component and the phase component are evident. The harmonic waveform generated by the harmonic waveform reproducer 64 is sent to the harmonic waveform accumulator 65.

The harmonic waveform accumulator 65 accumulates the waveforms of the respective harmonics sequentially sent from the harmonic waveform reproducer 64. Then, the result of the accumulation is outputted as a waveform data at a time (t). This waveform data outputted from the harmonic waveform accumulator 65 is the synthesized strong hit waveform data $W_t$ ($Aa_i$, $Pc_i$) including the strong hit amplitude component $Aa_i$ of the strong hit waveform data and the weak hit phase component $Pc_i$ of the weak hit waveform data, as shown in FIG. 2C, if the selection signal S1 is "0". Also, if the selection signal S1 is "1", the waveform data outputted from the harmonic waveform accumulator 65 is the synthesized weak hit waveform data $W_t$ ($Ac_i$, $Pa_i$ ) including the weak hit amplitude component $Ac_i$ of the weak hit waveform data and the strong hit phase component $Pa_i$ of the strong hit waveform data, although it is not shown. When the above-mentioned processes are ended, a waveform data at a time (t+1) is generated by the processes similar to the above-mentioned processes. The waveform data at the respective times are sequentially generated in this manner.

The synthesized strong hit waveform data W (Aa, Pc) and the synthesized weak hit waveform data W (Ac, Pa) which are generated as above-mentioned manner and correspond to a predetermined time period are used as follows. That is, the original strong hit waveform data W (Aa, Pa) is stored in the waveform memory as the strong hit waveform data, and the synthesized weak hit waveform data W (Ac, Pa) is stored in the waveform memory as the weak hit waveform data, respectively. Then, in accordance with play strength, both the waveforms are interpolated to generate a sound. In this case, the waveform data of the respective harmonics included in both the waveform data are identical in phase. Thus, the phase interference is never induced when the interpolation is executed. Hence, a tone closer to that of the acoustic instrument is obtained without damaging a tone color. Also, the synthesized strong hit waveform data W (Aa, Pc) is stored in the waveform memory as the strong hit waveform data, and the original weak hit waveform data W (Ac, Pc) is stored in the waveform memory as the weak hit waveform data, respectively. Then, in accordance with play strength, both the waveforms are interpolated to generate a sound. Therefore, such an effect similar to the above-mentioned effect can be obtained even in this case.

It should be noted that a noise component is not included in the waveform data generated in the first embodiment. However, it may be designed so as to generate the waveform data including the noise component. In this case, it may be designed to further add the waveform data including the noise component to the final waveform data generated by the harmonic waveform accumulator 65.

Second Embodiment

In the first embodiment, the waveform data generating apparatus is designed such that the synthesized waveform data is composed of the strong hit waveform data and the weak hit waveform data. However, in this second embodiment, the synthesized waveform data is constituted by three waveform data composed of a strong hit waveform data, a middle hit waveform data and a weak hit waveform data.

Figure 4:
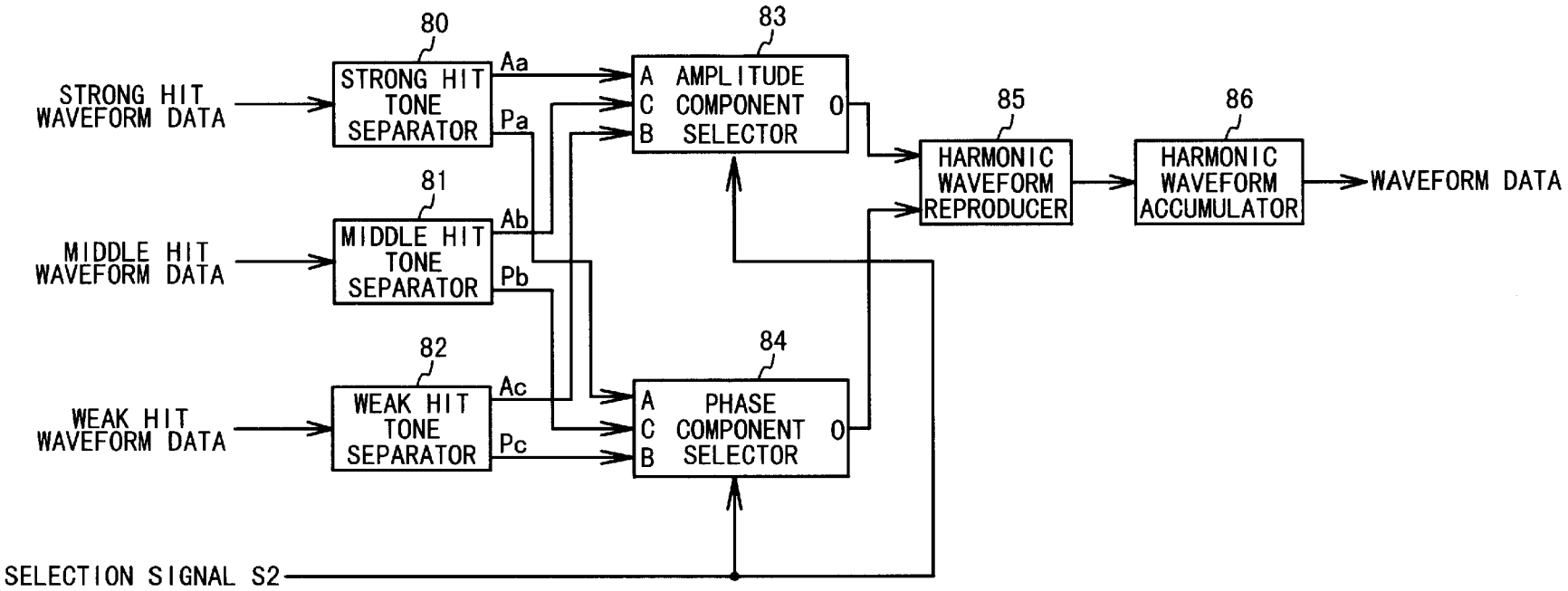
FIG. 4 is a functional block diagram showing a functional configuration of a waveform data generating apparatus according to a second embodiment of the present invention.

FIG. 4 is a functional block diagram showing a functional configuration of a waveform data generating apparatus according to the second embodiment of the present invention. Respective blocks shown in FIG. 4 may be attained in software or hardware. The strong hit waveform data and the weak hit waveform data used in this waveform data generating apparatus are generated similarly to the case of the first embodiment. The middle hit waveform data is generated by performing the pulse code modulation (PCM) on a signal according to a tone generated by hitting the keyboard of the piano at about middle strength. The sound pressure level of the tone is larger than a predetermined level SL1 and is smaller than another predetermined level SL2, where SL1 is larger than SL2. Hereafter, the middle hit waveform data is represented by $W_t$ ($Ab_i$, $Pb_i$)

The waveform data generating apparatus is composed of a strong hit tone separator 80, a middle hit tone separator 81, a weak hit tone separator 82, an amplitude component selector 83, a phase component selector 84, a harmonic waveform reproducer 85 and a harmonic waveform accumulator 86.

The configuration of the strong hit tone separator 80 is identical to that of the strong hit tone separator 60 of the first embodiment. The strong hit amplitude component $Aa_i$ separated by this strong hit tone separator 80 is sent to the amplitude component selector 83, and the strong hit phase component $Pa_i$ is sent to the phase component selector 84. Also, the configuration of the weak hit tone separator 82 is identical to that of the weak hit tone separator 61 of the first embodiment. The weak hit amplitude component $Ac_i$ separated by this weak hit tone separator 82 is sent to the amplitude component selector 83, and the weak hit phase component $Pc_i$ is sent to the phase component selector 84.

The middle hit tone separator 81 separates the middle hit amplitude component $Ab_i$ and the middle hit phase component $Pb_i$ from the inputted middle hit waveform data for each harmonic, and sequentially outputs them. The middle hit amplitude component $Ab_i$ separated by this middle hit tone separator 81 is sent to the amplitude component selector 83, and the middle hit phase component $Pb_i$ is sent to the phase component selector 84. The respective configurations of the strong hit tone separator 80, the middle hit tone separator 81 and the weak hit tone separator 82 are same and already described with reference to FIG. 3.

The amplitude component selector 83, if a selection signal S2 of one bit sent from external portion is "0", selects the strong hit amplitude component $Aa_i$ from the strong hit tone separator 80, and if it is "1", selects the weak hit amplitude component $Ac_i$ from the weak hit tone separator 82, and then sends to the harmonic waveform reproducer 85. The phase component selector 84, if the selection signal S2 is any of "0" and "1", selects the middle hit phase component $Pb_i$ from the middle hit tone separator 81, and then sends to the harmonic waveform reproducer 85.

The configurations and the operations of the harmonic waveform reproducer 85 and the harmonic waveform accumulator 86 are identical to those of the harmonic waveform reproducer 64 and the harmonic waveform accumulator 65 in the first embodiment, respectively. This harmonic waveform accumulator 86, if the selection signal S2 is "0", outputs the synthesized strong hit waveform data $W_t$ (Aa, Pb) including the strong hit amplitude component Aa of the strong hit waveform data and the middle hit phase component Pb of the middle hit waveform data at a time (t). Also, if the selection signal S2 is "1", the harmonic waveform accumulator 86 outputs the synthesized weak hit waveform data $W_t$ (Ac, Pb) including the weak hit amplitude component Ac of the weak hit waveform data and the middle hit phase component Pb of the middle hit waveform data. When the above-mentioned processes are ended, a waveform data at a time (t+1) is generated by the processes similar to the above-mentioned processes. The waveform data at the respective times are sequentially generated in this manner.

The synthesized strong hit waveform data W (Aa, Pb) and the synthesized weak hit waveform data W (Ac, Pb) which are generated as above-mentioned manner and correspond to predetermined time period are used as follows. That is, the synthesized strong hit waveform data W (Aa, Pb) is stored in the waveform memory as the strong hit waveform data, and the original middle hit waveform data W (Ab, Pb) is stored in the waveform memory as the middle hit waveform data, and the synthesized weak hit waveform data W (Ac, Pb) is stored in the waveform memory as the weak hit waveform data, respectively. Then, if the play strength ranges between the strong hit and the middle hit, the synthesized strong hit waveform data W (Aa, Pb) and the original middle hit waveform data W (Ab, Pb) are interpolated to generate a sound. If the play strength ranges between the middle hit and the weak hit, the original middle hit waveform data W (Ab, Pb) and the synthesized weak hit waveform data W (Ac, Pb) are interpolated to generate a sound. In this case, the phase components of the waveform data of the respective harmonics included in the three-waveform data are all Pb. Thus, the phase interference is never induced when the interpolation is executed. Hence, a tone closer to that of the acoustic instrument is obtained without damaging a tone color.

In this second embodiment, the case is described for generating a plurality of waveform data commonly including the middle hit phase components Pb. However, a plurality of waveform data commonly including the phase components Pa or the phase components Pc can be generated by suitably determining the amplitude component and the phase component to be selected in accordance with the selection signal S2. Also, in this second embodiment, the example is described in which the synthesized waveform data is generated in accordance with the three kinds of waveform data having different play strengths, such as the strong hit waveform data, the middle hit waveform data and the weak hit waveform data. However, it may be designed so as to prepare the synthesized waveform data in accordance with four or more kinds of waveform data having different play strengths.

It should be noted that a noise component is not included in the waveform data generated in the second embodiment. However, it may be designed so as to prepare the waveform data including the noise component. In this case, it may be designed to further add the waveform data including the noise component to the final waveform data generated by the harmonic waveform accumulator 86.

Third Embodiment

A waveform data generating apparatus according to a third embodiment of the present invention will be described below. This waveform data generating apparatus is constituted in software operating on various computer systems, such as a personal computer, a mini computer and a general-purpose computer. In this third embodiment, let us suppose that the synthesized waveform data is generated from the strong hit waveform data and the weak hit waveform data.

Figure 5:
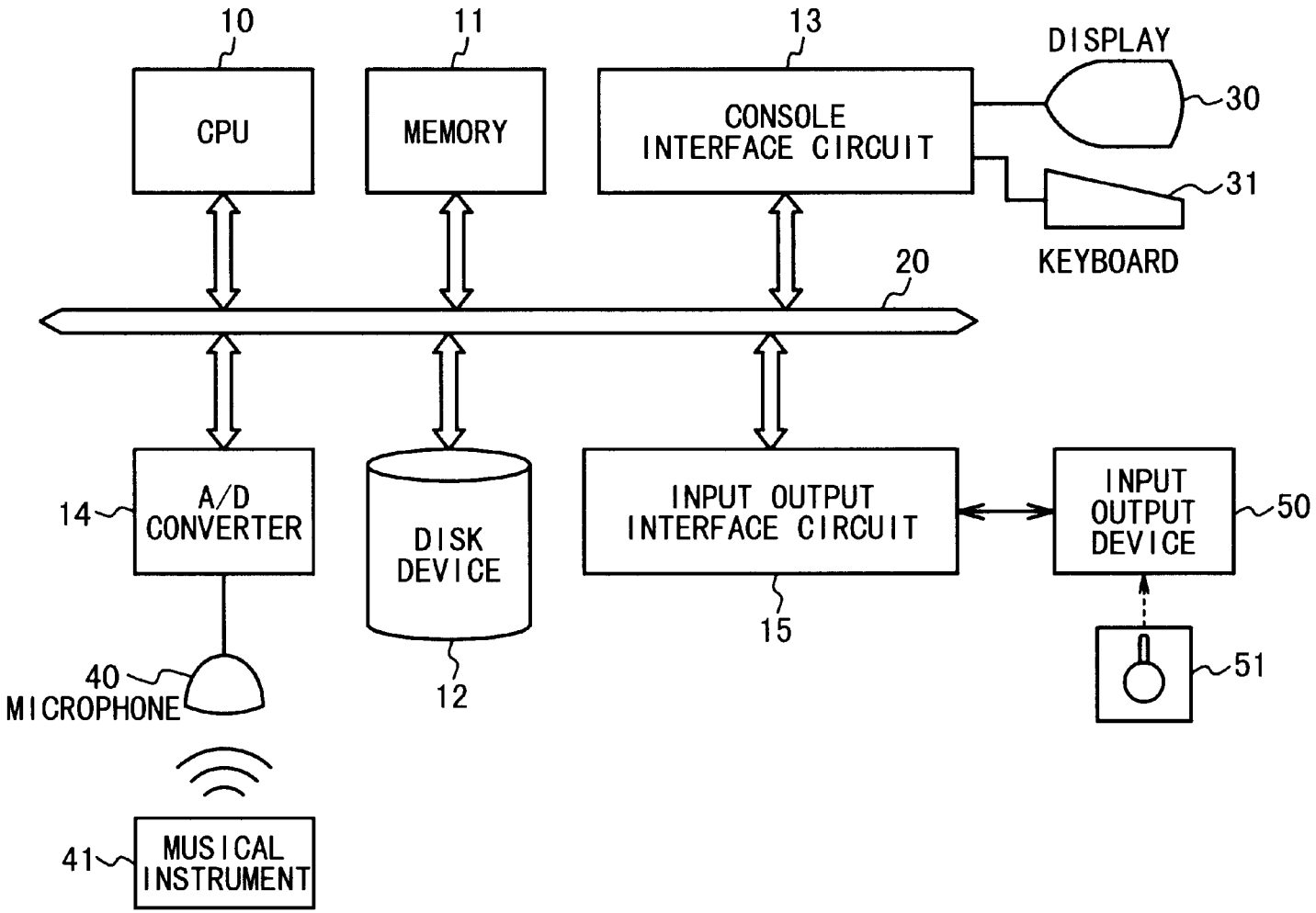
FIG. 5 is a block diagram showing a configuration of a waveform data generating apparatus using a computer system according to a third embodiment of the present invention.

FIG. 5 is a block diagram showing the configuration of a waveform data generating apparatus using the computer system. This waveform data generating apparatus is configured such that a central processing unit (hereafter, referred to as CPU) 10, a memory 11, a disk device 12, a console interface circuit 13, an A/D converter 14 and an input output interface circuit 15 are connected to a system bus 20. A display 30 and a keyboard 31 are connected to the console interface circuit 13. Also, a microphone 40 is connected to the A/D converter 14. Moreover, an input output device 50 is connected to the input output interface circuit 15.

The CPU 10 generates a waveform data in accordance with a program stored in the memory 11 (described later in detail). The memory 11 is constituted by, for example, a random access memory (hereafter, referred to as RAM). The memory 11 stores various data transiently in addition to the program. Various programs and data are stored in the disk device 12. Those programs and data stored in the disk device 12 are loaded to the memory 11, and used to execute various processes in the CPU 10.

The console interface circuit 13 controls an operation for sending and receiving a signal between the display 30, the keyboard 31 and the CPU 10. That is, a message generated by the CPU 10 is sent through this console interface circuit 13 to the display 30 to be displayed. Accordingly, an operator can prepare the waveform data while viewing a screen of the display 30. Also, the keyboard 31 is used for inputting various data. A parameter used for generating the waveform data is inputted through this keyboard 31.

The microphone 40 is connected to the A/D converter 14. The microphone 40 converts tone generated by a musical instrument 41 (piano) into an electrical analog signal. The electrical analog signal from this microphone 40 is sent to the A/D converter 14. The A/D converter 14 converts the electrical analog signal from the microphone 40 into a digital signal by using the PCM (Pulse Code Modulation) method. This converted digital signal is stored in the memory 11 as the strong hit waveform data and the weak hit waveform data under the control of the CPU 10.

The strong hit waveform data is generated such that the microphone 40 converts the tone generated by hitting the key of the piano into an analog electric signal and the A/D converter 14 converts the analog electric signal into the digital signal. Also, the weak hit waveform data is generated such that the microphone 40 converts the tone generated by hitting the key of the piano into an analog electric signal and the A/D converter 14 converts the analog electric signal into the digital signal.

The input output interface circuit 15 controls an operation for sending and receiving a signal between the input output device 50 and the CPU 10. A floppy disk device, an optical-magnetic disk device, a printer, a communication device, a ROM writer and the like are used as the input output device 50. If the floppy disk device is used as the input output device 50, the waveform data generated by this waveform data generating apparatus can be stored in a floppy disk 51 serving as a record medium. Accordingly, the waveform data can be moved to a waveform memory of a musical tone signal generating apparatus or other computers.

This floppy disk 51 can store therein a program constituting a part of the waveform data generating apparatus. In this case, when the program is installed in other computers or waveform data generating apparatuses, these apparatuses can execute an operation similar to that of this waveform data generating apparatus. Moreover, if the ROM writer is used as the input output device 50, the waveform data generated by this waveform data generating apparatus can be written to the ROM. Then, the ROM to which the waveform data is written can be used as a waveform memory 90 of a later-described musical tone signal generating apparatus.

Figure 6:
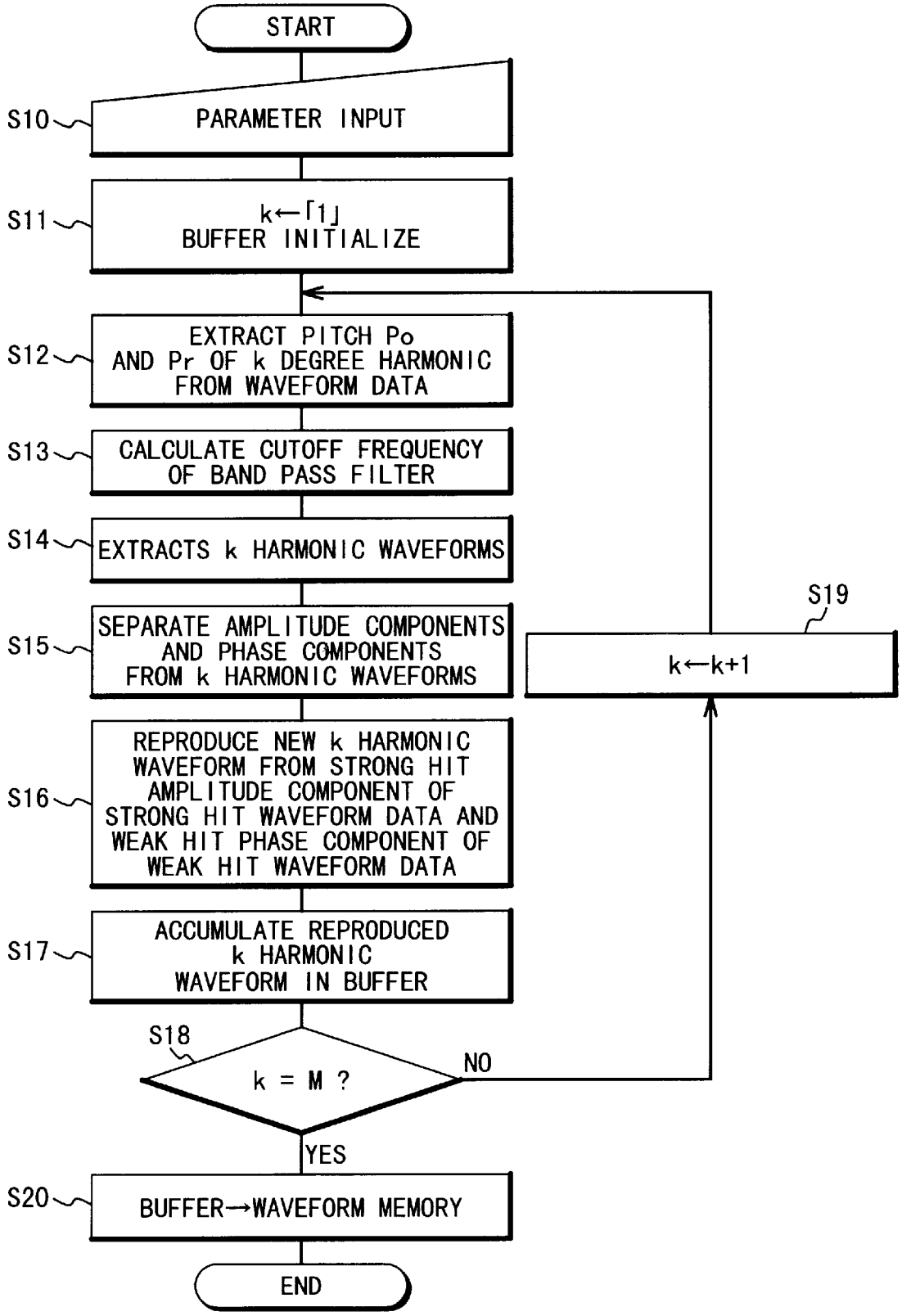
FIG. 6 is a flowchart showing an operation of the waveform data generating apparatus shown in FIG. 5.

The operation of this waveform data generating apparatus will be described below with reference to a flowchart shown in FIG. 6.

At first, parameters required to generate a waveform data is inputted from the keyboard 31 (Step S10). The parameters include a strong hit waveform data, a weak hit waveform data, a degree M of a harmonic targeted for a process and a band width Fb of the band pass filter. Next, a harmonic degree k as a variable is initialized to "1" and a buffer is initialized to zero (Step S11). Here, the buffer is arranged in the memory 11, and used for accumulating the respective harmonic waveforms.

Next, a pitch Po of a k degree harmonic included in the strong hit waveform data and a pitch Pr of a k degree harmonic included in the weak hit waveform data are extracted (Step S12). The pitches Po and Pr can be extracted by using the method similar to that of the first embodiment.

Next, a cutoff frequency of the band pass filter is calculated (Step S13). This calculation is equal to the process carried out by the cutoff frequency calculator 71 of the first embodiment.

The strong hit waveform data and the weak hit waveform data are filtered by the band pass filter having the cutoff frequencies Fc1, Fch and the sharp cutoff property (Step S14). Accordingly, the respective k harmonic waveforms in the strong hit waveform data and the weak hit waveform data are extracted. Then, the amplitude components and the phase components are separated from the respective k harmonic waveforms in the strong hit waveform data and the weak hit waveform data (Step S15).

Next, a new k harmonic waveform is reproduced from the strong hit amplitude component of the strong hit waveform data and the weak hit phase component of the weak hit waveform data (Step S16). The reproduced k harmonic waveform is accumulated in the buffer (Step S17). Then, it is judged whether or not k is equal to M, namely, whether or not the processes with regard to all harmonics targeted for the process are completed (Step S19). Here, such a judgement is made that k is not equal to M, k is incremented (by+1) (Step S19). After that, the sequence returns to the step S12.

Hereafter, the repetition of the similar processes enables the harmonic waveform to be sequentially accumulated in the buffer. In the middle of the repetition, if it is judged that the k is equal to the M at the step S18, the process of synthesizing the waveform data at the time (t) is ended. In this case, the content of the buffer becomes the finally synthesized waveform data at the time (t).

Next, the content of the buffer is written to the waveform memory (Step S20). That is, if the ROM writer is employed as the input output device 50, the CPU 10 sends the content of the buffer through the input output interface circuit 15 to the ROM writer. Accordingly, the ROM writer writes the synthesized waveform data to ROM. The synthesized weak hit waveform data W (Ac, Pa) as the weak hit waveform data or the synthesized strong hit waveform data W (Aa, Pc) as the strong hit waveform data is written to the ROM, since the above-mentioned processes are repeated from the time (t) for a predetermined period. The ROM to which the synthesized waveform data is written in this way is used as the waveform memory 90 of the later-described musical tone signal generating apparatus. Although not shown, if the synthesized weak hit waveform data W (Ac, Pa) is written to the ROM as the weak hit waveform data, the original strong hit waveform data W (Aa, Pa) is written to the ROM as the strong hit waveform data. On the other hand, if the synthesized strong hit waveform data W (Aa, Pc) is written to the ROM as the strong hit waveform data, the original weak hit waveform data W (Ac, Pc) is written to the ROM as the weak hit waveform data.

If the floppy disk device is used as the input output device 50, the CPU 10 sends the content of the buffer through the input output interface circuit 15 to the floppy disk device. Accordingly, the floppy disk device writes the waveform data to the floppy disk 51. If the later-described waveform memory 90 is composed of ROM, the content of the floppy disk 51 can be written to the ROM by using another prepared ROM writer. Also, if the later-described waveform memory 90 is composed of RAM, it may be designed such that the content of the floppy disk 51 is loaded to the RAM when the operation of the musical tone signal generating apparatus is started.

Fourth Embodiment

The musical tone signal generating apparatus using the waveform data generated by the above-mentioned waveform data generating apparatus will be described below. This musical tone signal generating apparatus can be used as an independent tone source device or as a tone source mounted in an electronic instrument.

Figure 7:
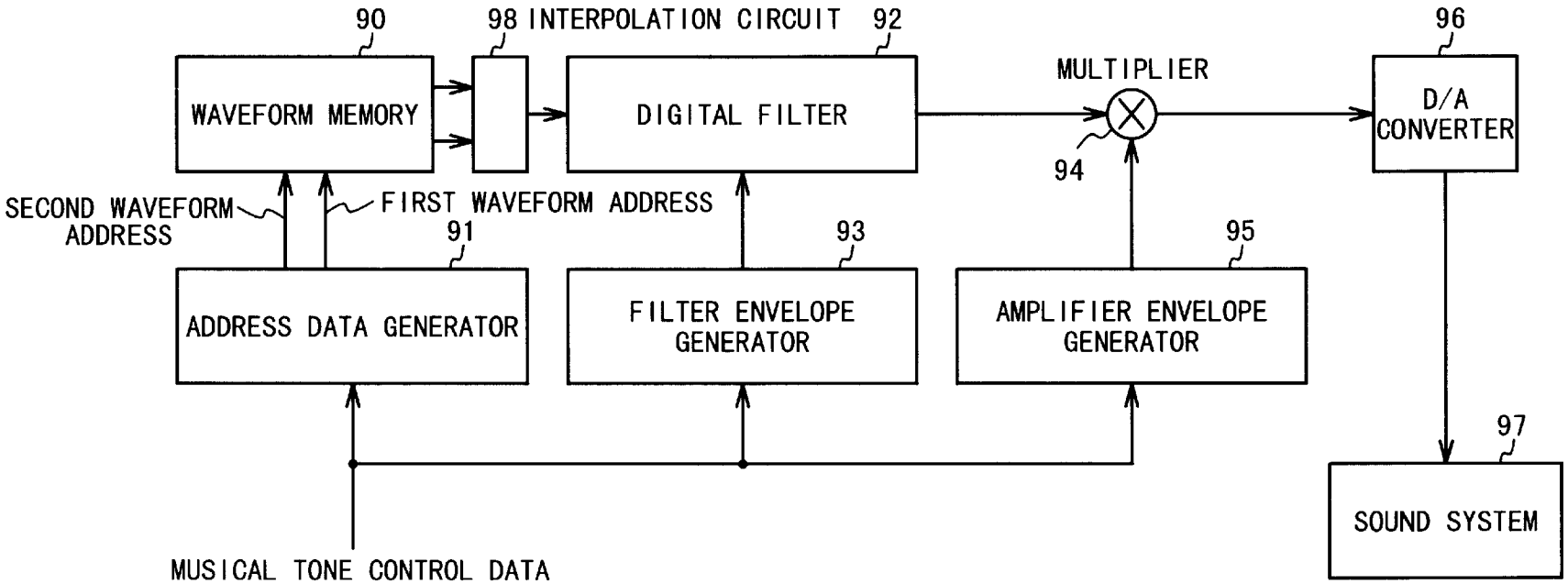
FIG. 7 is a block diagram showing a configuration of a musical tone signal generating apparatus according to a fourth embodiment of the present invention.

FIG. 7 is a block diagram showing the configuration of the musical tone signal generating apparatus. This musical tone signal generating apparatus is composed of the waveform memory 90, an address data generator 91, a digital filter 92, a filter envelope generator 93, a multiplier 94, an amplifier envelope generator 95, a D/A converter 96 and an interpolation circuit 98. A sound system 97, such as a speaker, a headphone and the like, is connected to the D/A converter 96.

The waveform memory 90 stores therein the original strong hit waveform data W (Aa, Pa) as the strong hit waveform data, and stores therein the synthesized weak hit waveform data W (Ac, Pa) generated by the waveform data generating apparatus as the weak hit waveform data.

A musical tone control data sent from external portion is supplied to this musical tone signal generating apparatus. This musical tone control data includes a first waveform address, a second waveform address, a play strength data, a frequency data, a filter data, an envelope data, and the like. The first waveform address specifies a position to start reading the strong hit waveform data in the waveform memory 90. The second waveform address specifies a position to start reading the weak hit waveform data in the waveform memory 90. The first and second waveform addresses are generated in accordance with the play strength and the tone color selected at that time. The play strength data is used as an interpolation parameter. The frequency data specifies a speed at which the waveform data is read out from the waveform memory 90. The filter data specifies the filter characteristic of the digital filter 92, which is changed in conjunction with an elapse of a time. The envelope data specifies the shape of the envelope applied to the filtered waveform data.

The first and second waveform addresses and the frequency data included in the musical tone control data are sent to the address data generator 91, the play strength data is sent to the interpolation circuit 98, the filter data is sent to the filter envelope generator 93, and the envelope data is sent to the amplifier envelope generator 95, respectively.

The address data generator 91 employs the first and second waveform addresses included in the musical tone control data as respective initial values, and generates first and second read out addresses which are sequentially increased every temporal interval specified by the frequency data. Those generated first and second read out addresses are sent to the waveform memory 90. Thus, when the musical tone control data sent from external portion is supplied to the address data generator 91, the strong hit waveform data specified by the first waveform address and the weak hit waveform data specified by the second waveform address are sequentially read out from the waveform memory 90 with the speed specified by the frequency data included in the musical tone control data. The strong hit waveform data and the weak hit waveform data read out from the waveform memory 90 are sent to the interpolation circuit 98.

The interpolation circuit 98 interpolates the strong hit waveform data and the weak hit waveform data read out from the waveform memory 90, in accordance with the play strength data. This interpolation enables the generation of the waveform data having the tone color in accordance with the play strength. The waveform data interpolated by the interpolation circuit 98 is sent to the digital filter 92.

The filter envelope generator 93 sequentially generates a filter coefficient whose value is changed in conjunction with an elapse of a time. This filter coefficient is sent to the digital filter 92.

The digital filter 92, in accordance with the filter coefficient sent from the filter envelope generator 93, filters the waveform data read out from the waveform memory 90. The filter envelope generator 93, when the filter data is supplied from external portion, starts generating the filter coefficient, and at the same time, the digital filter 92 starts the filtering process. Accordingly, the waveform data in which the frequency characteristic is varied in conjunction with an elapse of a time is obtained from the digital filter 92. The filtered waveform data from the digital filter 92 is sent to the multiplier 94.

The amplifier envelope generator 95, in accordance with the envelope data included in the musical tone control data, generates an amplification factor whose value is varied in conjunction with an elapse of a time, in other words, an amplification coefficient to specify the shape of the envelope of the waveform. This amplification factor generated by the amplifier envelope generator 95 is sent to the multiplier 94.

The multiplier 94 multiplies the filtered waveform data from the digital filter 92 by the amplification coefficient from the amplifier envelope generator 95. The amplifier envelope generator 95, when the envelope data is supplied from external portion, starts generating the amplification coefficient, and at the same time, the multiplier 94 starts the multiplying process. Accordingly, the multiplier 94 outputs the waveform data to which the envelope varied in conjunction with an elapse of a time is applied. An output of the multiplier 94 is sent to the D/A converter 96.

The D/A converter 96 converts a digital waveform data outputted by the multiplier 94 into an analog musical tone signal. This musical tone signal outputted from the D/A converter 96 is sent to the sound system to generate a sound. Above mentioned musical tone signal generating apparatus according to the fourth embodiment of the present invention generates the musical tone signal based on the waveform data generated by interpolating between the synthesized waveform data generated by the above-mentioned waveform data generating apparatus and the original waveform data having the same phase as the synthesized waveform data. Thus, when the interpolation operation is executed, the phase interference is never induced so that the tone color generated in accordance with the generated musical tone signal is not damaged. Also, the envelopes of the respective harmonics included in the generated musical tone signal remain in their original states. Hence, the musical tone signal can be generated in which the excellent change of the tone color is obtained similarly to that of the natural instrument.

In the fourth embodiment, the waveform memory 90 is designed so as to store therein one set of waveform data composed of the strong hit waveform data and the weak hit waveform data, which corresponds to one tone color (tone of an instrument). However, this waveform memory 90 may be designed so as to store therein a plurality of sets of waveform data corresponding to a plurality of tone areas in a tone of one instrument, respectively. In this case, a musical tone control data is prepared for each tone area. This configuration enables the faithful simulation of the tone of the natural instrument having different tone colors depending on the tone area. In addition, it is natural that the waveform memory 90 can store therein a plurality of sets of waveform data corresponding to a plurality of tone colors, respectively.

As detailed above, the present invention can provide the waveform data generating apparatus and the waveform data generating method that generate the waveform data in which the smooth change of the tone color is obtained in accordance with the play strength similar to that of the natural instrument. Also, the present invention can provide the musical tone signal generating apparatus that generates the musical tone signal in which the smooth change of the tone color is obtained in accordance with the play strength similar to that of the natural instrument, irrespectively of the small body and the low cost.

What is claimed is:

1. A waveform data generating apparatus comprising:

a separator which separates n kinds of amplitude components and n kinds of phase components from n kinds of waveform data, where n is an integer equal to or greater than 2; and a synthesizer which synthesizes each of m kinds of amplitude components from said n kinds of amplitude components separated by said separator and one of said n kinds of phase components to generate m kinds of synthesized waveform data, where m is an integer equal to or greater than 1, and $m \leqq n$.

2. The waveform data generating apparatus according to claim 1, wherein said n kinds of waveform data are composed of strong hit waveform data based on a tone of a strong play strength and weak hit waveform data based on a tone of a weak play strength, such that the tone of the strong play strength indicates that a sound pressure level of the tone of the strong play strength is larger than a predetermined level and the tone of the weak play strength indicates that a sound pressure level of the tone of the weak play strength is smaller than said predetermined level, and wherein said separator includes:

a strong hit tone separator which separates a strong hit amplitude component and a strong hit phase component from said strong hit waveform data, and a weak hit tone separator which separates a weak hit amplitude component and a weak hit phase component from said weak hit waveform data; and wherein said synthesizer synthesizes said strong hit amplitude component separated by said strong hit tone separator and said weak hit phase component separated by said weak hit tone separator to generate a synthesized strong hit waveform data.

3. The waveform data generating apparatus according to claim 2, wherein said synthesizer synthesizes said weak hit amplitude component separated by said weak hit tone separator and said strong hit phase component separated by said strong hit tone separator to generate a synthesized weak hit waveform data.

4. The waveform data generating apparatus according to claim 2, wherein said synthesizer further includes:

an amplitude component selector which selects one of said strong hit amplitude component separated by said strong hit tone separator and said weak hit amplitude component separated by said weak hit tone separator, in response to a externally supplied selection signal;

a phase component selector which selects one of said strong hit phase component separated by said strong hit tone separator and said weak hit phase component separated by said weak hit tone separator; and a waveform reproducer which synthesizes an amplitude component selected by said amplitude component selector and a phase component selected by said phase component selector to generate a synthesized waveform data.

5. The waveform data generating apparatus according to claim 4, wherein said waveform reproducer synthesizes said strong hit amplitude component selected by said amplitude component selector and said weak hit phase component selected by said phase component selector to generate a synthesized strong hit waveform data.

6. The waveform data generating apparatus according to claim 4, wherein said waveform reproducer synthesizes said weak hit amplitude component selected by said amplitude component selector and said strong hit phase component selected by said phase component selector to generate a synthesized weak hit waveform data.

7. The waveform data generating apparatus according to claim 1, wherein said n kinds of waveform data are composed of strong hit waveform data based on a tone of a strong play strength, middle hit waveform data based on a tone of a middle play strength and weak hit waveform data based on a tone of a weak play strength, wherein the tone of the strong play strength indicates that a sound pressure level of the tone of the strong play strength is larger than a first predetermined level and the tone of the weak play strength indicates that a sound pressure level of the tone of the weak play strength is smaller than a second predetermined level and the tone of a middle play strength indicates that a sound pressure level of the tone of the middle play strength is larger than the second predetermined level and is smaller than the first predetermined level, where the first predetermined level is greater than the second predetermined level, and wherein said separator includes:

a strong hit tone separator which separates a strong hit amplitude component and a strong hit phase component from said strong hit waveform data, a middle hit tone separator which separates a middle hit amplitude component and a middle hit phase component from said middle hit waveform data, a weak hit tone separator which separates a weak hit amplitude component and a weak hit phase component from said weak hit waveform data; and wherein said synthesizer synthesizes said strong hit amplitude component separated by said strong hit tone separator and said middle hit phase component separated by said middle hit tone separator to generate a synthesized strong hit waveform data.

8. The waveform data generating apparatus according to claim 7, wherein said synthesizer synthesizes said weak hit amplitude component separated by said weak hit tone separator and said middle hit phase component separated by said middle hit tone separator to generate a synthesized weak hit waveform data.

9. The waveform data generating apparatus according to claim 7, wherein said synthesizer further includes:

an amplitude component selector which selects one of said strong hit amplitude component separated by said strong hit tone separator, said middle hit amplitude component separated by said middle hit tone separator and said weak hit amplitude component separated by said weak hit tone separator, in response to an externally supplied selection signal;

a phase component selector which selects one of said strong hit phase component separated by said strong hit tone separator, said middle hit phase component separated by said middle hit tone separator and said weak hit phase component separated by said weak hit tone separator; and a waveform reproducer which synthesizes an amplitude component selected by said amplitude component selector and a phase component selected by said phase component selector to generate a synthesized waveform data.

10. The waveform data generating apparatus according to claim 9, wherein said waveform reproducer synthesizes said strong hit amplitude component selected by said amplitude component selector and said middle hit phase component selected by said phase component selector to generate a synthesized strong hit waveform data.

11. The waveform data generating apparatus according to claim 9, wherein said waveform reproducer synthesizes said weak hit amplitude component selected by said amplitude component selector and said middle hit phase component selected by said phase component selector to generate a synthesized weak hit waveform data.

12. The waveform data generating apparatus according to claim 1, wherein each of said n kinds of waveform data includes a plurality of harmonic waveform data, and wherein said separator separates said n kinds of amplitude components and said n kinds of phase components from said plurality of harmonic waveform data for every harmonic waveform, and wherein said synthesizer includes:

a harmonic waveform reproducer which reproduces each of m kinds of amplitude components from said n kinds of amplitude components separated by said separator and one of said n kinds of phase components to generate a plurality of synthesized harmonic waveform data for every harmonic waveform; and an accumulator which accumulates said plurality of synthesized harmonic waveform data generated by said harmonic waveform reproducer to generate said m kinds of synthesized waveform data.

13. The waveform data generating method comprising:

separating n kinds of amplitude components and n kinds of phase components from n kinds of waveform data, where n is an integer equal to or greater than 2; and synthesizing each of m kinds of amplitude components from said n kinds of amplitude components and one of said n kinds of phase components to generate m kinds of synthesized waveform data, where m is an integer equal to or greater than 1, and $m \leqq n$.

14. The waveform data generating method according to claim 13, wherein said n kinds of waveform data includes strong hit waveform data being based on a tone of a strong play strength and weak hit waveform data being based on a tone of a weak play strength, wherein the tone of the strong play strength indicates that a sound pressure level of the tone of the strong Play strength is larger than a predetermined level and the tone of the weak play strength indicates that a sound pressure level of the tone of the weak play strength is smaller than said predetermined level, and wherein said separating step includes:

separating a strong hit amplitude component and a strong hit phase component from said strong hit waveform data; and separating a weak hit amplitude component and a weak hit phase component from said weak hit waveform data, and wherein said synthesizing step includes synthesizing said strong hit amplitude component and said weak hit phase component to generate a synthesized strong hit waveform data.

15. The waveform data generating method according to claim 14, wherein said synthesizing step includes synthesizing said weak hit amplitude component and said strong hit phase component to generate a synthesized weak hit waveform data.

16. The waveform data generating method according to claim 13, wherein said n kinds of waveform data includes strong hit waveform data being based on a tone of a strong play strength, middle hit waveform data being based on a tone of a middle play strength and weak hit waveform data being based on a tone of a weak play strength, wherein the tone of the strong play strength indicates that a sound pressure level of the tone of the strong play strength is larger than a first predetermined level and the tone of the weak play strength indicates that a sound pressure level of the tone of the weak play strength is smaller than a second predetermined level and the tone of a middle play strength indicates that a sound pressure level, of the tone of the middle play strength is larger than said second predetermined level and is smaller than said first predetermined level, where said first predetermined level is larger than said second predetermined level, and wherein said separating step includes:

separating a strong hit amplitude component and a strong hit phase component from said strong hit waveform data;

separating a middle hit amplitude component and a middle hit phase component from said middle hit waveform data; and separating a weak hit amplitude component and a weak hit phase component from said weak hit waveform data, and wherein said synthesizing step includes synthesizing said strong hit amplitude component and said middle hit phase component to generate a synthesized strong hit waveform data.

17. The waveform data generating method according to claim 16, wherein said synthesizing step includes synthesizing said weak hit amplitude component and said middle hit phase component to generate a synthesized weak hit waveform data.

18. The waveform data generating method according to claim 13, wherein each of said n kinds of waveform data includes a plurality of harmonic waveform data, and wherein said separating step includes separating said n kinds of amplitude components and said n kind of phase components from said plurality of harmonic waveform data from every harmonic waveform, and wherein said synthesizing step includes:

reproducing each of m kinds of amplitude components from said n kinds of amplitude components and one of said n kinds of phase components to generate a plurality of synthesized harmonic waveform data for every harmonic waveform; and accumulating said plurality of synthesized harmonic waveform data to generate said m kinds of synthesized waveform data.

* * * * *